US009168775B2

(12) United States Patent
Zehetner et al.

(10) Patent No.: US 9,168,775 B2
(45) **Date of Patent: *Oct. 27, 2015**

(54) SEALED STAMP CARTRIDGE AND ROUND STAMP MOVABLE INTO POSITIONING SETTING FOR ROTATION OF PRINTING PLATE ABOUT THE AXIS OF MOVEMENT

(71) Applicant: Trodat GmbH, Wels (AT)

(72) Inventors: Markus Zehetner, Leonding (AT); Manfred Ortner, Pennewang (AT); Christian Rupp, Zeltweg (AT)

(73) Assignee: Trodat GmbH (AT)

( * ) Notice: Subject to any disclaimer, the term of this patent is extended or adjusted under 35 U.S.C. 154(b) by 0 days.

This patent is subject to a terminal disclaimer.

(21) Appl. No.: 13/893,718

(22) Filed: May 14, 2013

(65) Prior Publication Data

US 2013/0305940 A1 Nov. 21, 2013

(30) Foreign Application Priority Data

May 15, 2012 (AT) ..... A 583/2012

(51) Int. Cl.

| | |
|---|---|
| ***B41K 1/38*** | (2006.01) |
| ***B41K 1/50*** | (2006.01) |
| ***B41K 1/54*** | (2006.01) |
| ***B41K 1/02*** | (2006.01) |
| ***B41K 1/06*** | (2006.01) |

(52) U.S. Cl.

CPC ... *B41K 1/38* (2013.01); *B41K 1/02* (2013.01); *B41K 1/06* (2013.01); *B41K 1/50* (2013.01)

(58) Field of Classification Search

CPC ..... B41K 1/38; B41K 1/54; B41K 1/52; B41K 1/50; B41K 1/02

USPC ..... 101/333, 327, 405, 406, 103, 109

IPC ..... B41K 1/38,1/54, 1/50

See application file for complete search history.

(56) References Cited

U.S. PATENT DOCUMENTS

| | | | | | |
|---|---|---|---|---|---|
| 827,347 | A * | 7/1906 | Campbell | 101/334 |
| 859,310 | A * | 7/1907 | Matthews | 101/334 |
| 4,594,943 | A | 6/1986 | Nettesheim et al. | |
| 5,510,820 | A * | 4/1996 | Aulick et al. | 347/85 |
| 6,834,584 | B1 * | 12/2004 | MacNeil | 101/333 |
| 2005/0056173 | A1 | 3/2005 | Dour | |
| 2009/0101032 | A1 * | 4/2009 | Slane et al. | 101/333 |
| 2012/0006214 | A1 * | 1/2012 | Feilecker et al. | 101/333 |

FOREIGN PATENT DOCUMENTS

| | | | |
|---|---|---|---|
| DE | 2912985 | A1 | 10/1979 |
| GB | 2197821 | A | 6/1988 |
| JP | 2003305932 | A * | 10/2003 |
| WO | 2004060685 | A1 | 7/2004 |

* cited by examiner

*Primary Examiner* — Leslie J Evanisko

(74) *Attorney, Agent, or Firm* — Lerner, David, Littenberg, Krumholz & Mentlik, LLP

(57) ABSTRACT

A stamp includes a printing unit and an actuator unit. The printing unit is connected to the actuator unit by a connecting element. The printing unit includes a support element and a printing plate the cross section of which is round. The printing plate is stabilized by the support element. The printing unit is moveable from a neutral setting into a print setting through axial displacement by the actuator unit. The printing plate can be moved further by axial displacement into a positioning setting wherein the printing plate can be rotated in its angular position relative to the actuator unit.

28 Claims, 8 Drawing Sheets

Fig.11
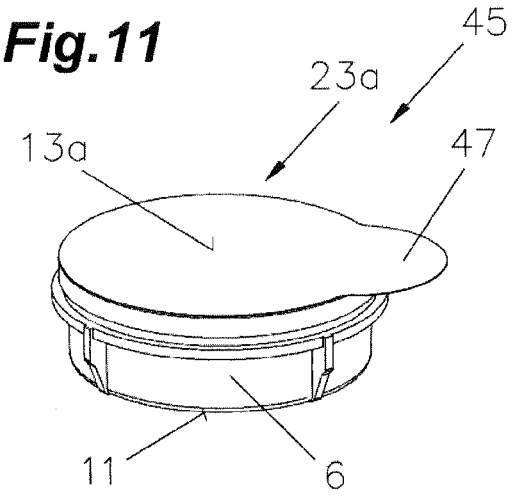
Fig.12
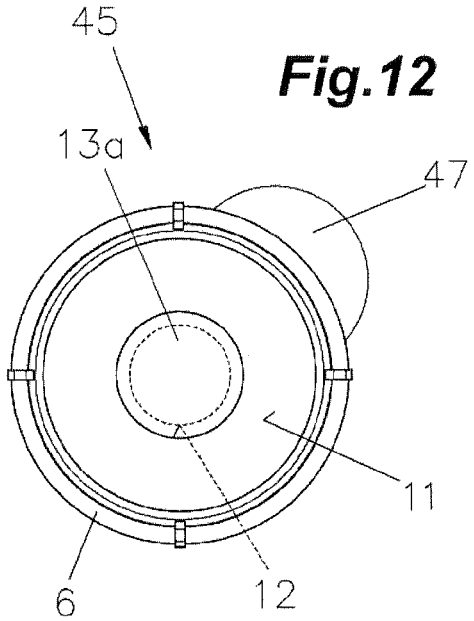
Fig.13
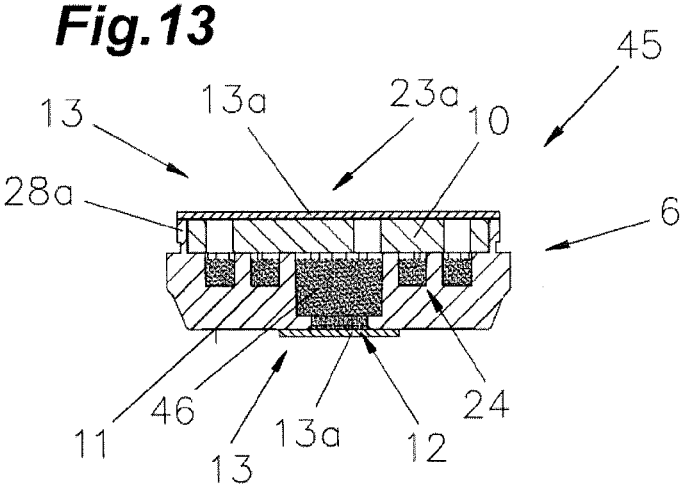
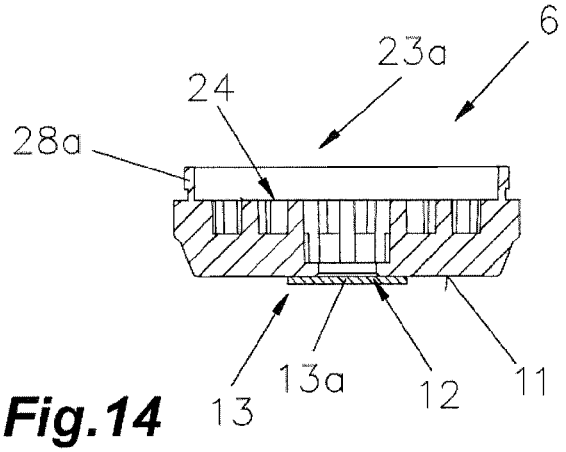
Fig.14

SEALED STAMP CARTRIDGE AND ROUND STAMP MOVABLE INTO POSITIONING SETTING FOR ROTATION OF PRINTING PLATE ABOUT THE AXIS OF MOVEMENT

BACKGROUND OF THE INVENTION

The invention relates to a stamp comprising a printing unit, an actuator unit and a connecting element, wherein the printing unit is connected to the actuator unit by means of the connecting element, wherein the printing unit further features a support element and a printing plate and the printing plate is stabilized by the support element, and wherein the printing unit is moveable from a neutral setting into a print setting by means of the actuator unit via axial displacement.

The invention further relates to a stamp cartridge for a round stamp for initial filling or refilling with ink comprising a pan-shaped support element with a pan bottom and at least one lateral wall and with an open top side formed on the opposite side of the pan bottom used for insertion of an ink storage body.

In addition, however, the invention relates to a semi-finished product for a round stamp comprising a pan-shaped support element with a pan bottom and at least one lateral wall and an open top side formed on the opposite side of the pan bottom used for insertion of an ink storage body.

Apart from conventional stamps with rectangular and square printing plates, prior art, such as WO 2004/060685 A1 or US 2005/0056173 A1, also describes what are known as round stamps. In these cases, the cross section of the printing plate is embodied as a round shape. One of the problems with existing stamps referred to as "pre-inked stamps" or similar is the process of correctly positioning such round printing plates. This means that the print and/or printed image is to be aligned with the front of the stamp because round stamps and/or stamps usually feature an inspection window revealing the print image at the top side or laterally. If the relative position of the print image in the inspection window and the platen do not coincide, the printing plate generates a correspondingly distorted print image when the stamp is aligned in accordance with the print image in the inspection window. This is not an issue in the case of a rectangular printing plate because for reasons of geometry there are only two options for installing the printing plate into the stamp housing whereas, in theory, there are an infinite number of positions available for the installation of round printing plates.

Therefore, in the case of prior art products, from the time of what is referred to as flashing (or of laser stamp and/or gel stamp die production), care must be taken to align the printing plate correctly with the remaining stamping device components. In most instances, the print image is facing the tabletop, actually making a check of said image impossible prior to final stamping device assembly, thus further complicating the assembly process. In addition, the necessary connecting components must also be positioned correctly in order to clamp the printing plate.

Publications DE 29 12 985 A1 and U.S. Pat. No. 4,594,943 A describe hand stamps featuring an anti-rotation element in the form of interlocking connections allowing for modification of the vertical position of the printing plate.

Publication GB 2 197 821 discloses a hand stamp with a round printing plate, wherein the plug-in handle is secured against rotating by means of two tongue and groove connections but it cannot be adjusted.

For this reason, the object of the present invention is to provide an option designed to simplify the assembly of round stamps. Another object lies in reducing the time required to produce the stamp, in particular the saturation time for the ink storage body.

BRIEF SUMMARY OF THE INVENTION

This object of the innovation is solved by the aforementioned stamp, the printing plate of which can be moved by way of axial displacement into a positioning setting, allowing for the printing plate to be rotated in its angular position relative to the actuator unit. Thus, when mounting the printing plate, it is no longer necessary to ensure proper alignment of the print image relative to the entire stamp, as has been customary thus far; likewise there is no need to ensure proper positioning of the parts required for the assembly, because as a result of the positioning setting and the related ability to rotate the printing plate, the latter can be aligned once the entire stamp has been assembled. In other words, radial positioning of the parts is immaterial during assembly. Thus it will not only be easier for the merchant to assemble the stamp in the correct position, but it will also be easier for the user to reestablish the correct position of the printing plate upon replacement without having to consider the relative position when installing the printing plate into the stamp.

According to one version of the invention's embodiment, the plan is for the print setting to be formed between the neutral setting and positioning setting, in other words so that in the axial direction the positioning setting is reached after the print setting by way of axial displacement, causing the printing plate to protrude further from the printing unit and therefore to be gripped more easily.

As a result it is easier to position the printing plate, i.e. to establish the correct angular position of the printing plate relative to the entire stamp.

The printing plate may also be stabilized on the printing unit by means of a holding ring wherein the holding ring can be rotated in the positioning setting of the printing plate. As a result it is not necessary to touch the printing plate in order to rotate it, instead, the correct relative angular position of the printing plate can be achieved by rotating the holding ring, a process that allows for a cleaner adjustment since printing plates known as pre-inked stamps are saturated with ink.

It is possible that the printing unit features a support element for the printing plate, wherein said support element is connected to the holding ring by means of a clip-on or snap-on connection. This not only simplifies the assembly of the stamp in that the holding ring merely has to be clipped onto the support element; it also facilitates fixing the printing plate in the support element once the angular position is correct or adjusting the printing plate in its relative angular position.

The preferred design of this clip-on or snap-on connection is a tongue and groove connection that enables a stamp design allowing for the holding ring and printing plate to be rotated in any position.

Moreover, the plan may call for the actuator unit to feature a housing unit for at least partial accommodation of the printing unit, wherein at least one anti-rotation element for the printing unit is arranged on an interior housing surface facing the printing unit and/or on an exterior surface of the support element or holding ring facing the interior housing surface. It is therefore possible to form the stamp in such a way that, depending on the relative position of the printing unit to the actuator unit, the anti-rotation element becomes effective in the axial direction or, in the positioning setting, the anti-rotation element is released and thus the printing plate can be rotated easily. Thus, by way of simple axial displacement it is possible to allow the printing plate to be rotated or, once the anti-rotation element becomes effective in the print setting as well, the printing plate can be protected from unintentional rotation.

The anti-rotation element can be formed by ribs protruding from the interior surface of the housing in the direction of the print unit and/or from the exterior surface of the support element in the direction of the interior housing surface. Thus, in the neutral and/or print setting it is possible for this anti-rotation element to abut against the respective opposite surface of the housing or the support element and any unintended rotation is prevented as a result of the friction lock.

To increase anti-rotation safety, it is also possible to provide at least one groove on the interior housing surface or the exterior surface of the support element, with the groove working together with a rib, i.e. the rib engaging with this groove or, as a result of axial displacement into the positioning setting, the rib slipping out of the groove and thus achieving the ability to rotate.

According to a further version of the embodiment it is possible that the anti-rotation element is provided on the interior housing surface or the exterior surface of the support element and/or the holding ring in form of gearing. Thus the anti-rotation safety can be increased at least in the print setting by interlocking teeth as long as housing and support element or holding ring are equipped with gearing. On the other hand, it is also possible to achieve a large adjustment range for rotating the printing plate on the one hand and easier adjustability of the printing plate on the other, because these ribs glide easily from the gearing or the interlocking gearing is released by axial displacement into the positioning setting, in particular as a result of gearing around the circumference of housing or support element and/or holding ring, with possibly only ribs formed on support element and/or holding ring or interior housing surface working together with the respective gearing on the opposite side.

According to another version of the embodiment the plan may be to connect the holding ring to the support element by means of a screw connection or a bayonet catch. On the one hand, it provides a relatively inexpensive and simple option for fixing the printing plate to the holding ring, wherein the thread on the holding ring or support element or the respective bayonet catch is formed so that in the unscrewed or closed state the printing plate is prevented from rotating at least as a result of friction or clamping contact. On the other hand the positioning setting may also coincide with the print setting, thereby possibly reducing the overall stamp length, in particular with formations of pocket stamps, because as a result of releasing the friction or clamping contact between the holding ring and the printing plate, such as through a quarter rotation of the holding ring, the printing plate is released for rotation without the need for disassembling the stamp first, as is the case with the versions of the embodiment described above.

The support element may feature at least one opening that can be used to establish a connection with the actuator unit by means of a connecting element and/or to serve as the refill opening for stamping ink. This creates a simple option for connecting the actuator unit and the support element and/or an easy way to resaturate the stamp.

In addition, the printing unit can be developed so that it can be moved by way of axial displacement into a third or fourth setting known as an unlocking setting, where the connecting element releases its connection to the supporting element. Therefore, it is in particular the version of the embodiment with the opening in the support element mentioned last that allows for removal of the entire print unit from the stamp, thereby not only facilitating simple replacement of the printing plate or replacement or renewal of the ink pad for the printing plate. It also facilitates rotating the printing plate within a smaller angle range, i.e. the range does not have to be 360°, but it can be preset roughly during assembly and the setting fine-tuned in the positioning setting by rotating the printing plate. If the process of rough presetting should prove insufficient, there is the option to remove the entire print unit easily from the stamp and to align it again.

The connecting element may feature at least one catch post, preferably two opposing catch posts, connecting the actuator unit with the printing unit. Especially in the version of the embodiment featuring the opening in the support element, the printing unit can be removed easily in the unlocking position by compressing the catch posts and/or it is easily installed by snapping the printing unit into place.

In this arrangement at least two catch posts can be positioned to one another in such a way that a gap formed between them narrows towards the support element so that a simple axial displacement enables the catch posts to be compressed automatically and thus the printing unit is released. Therefore, except for the axial displacement, removal of the printing unit does not require any additional steps.

The advantage here is that in cases where the catch post(s) feature(s) at least three sections, at least two of which are approximately vertical and a section in between formed to traverse at an angle, it is once again easy to release the printing unit by compressing the catch posts for one, and for another, it is possible to achieve improved stabilization a result of the vertical end sections, i.e. interlocking the connecting element with the support element.

Another formation with the opening of the support element sealed liquid-tight by means of a sealing element, in particular foil, is also advantageous because it permits filling the interior space of the support element with ink. Thus, filling is made easy.

However, the foil may also be formed of thermal coated aluminum foil featuring a thickness of 30-50 μm and a directly extruded polymer coating on the foil, preferably of 20-50 μm thickness because it provides an easy way to establish a liquid-tight seal for the support element, in particular the opening, or seal it in a liquid-tight manner.

In a formation where the support element features two areas, one of them formed to accommodate the ink and the other one formed to hold the ink storage body, it is possible to fill the support element separately, thereby significantly reducing the filling time; as a result, there is no longer a need to wait until the ink is absorbed by the ink storage body, because the ink is no longer poured directly onto the ink storage body, a process that would require a lengthy saturation time.

However, a formation where the support element features indicator elements, especially pins, is also advantageous, because it will allow for easy control of the ink volume poured in.

Even so, the object of the invention is also solved in that at least one opening is arranged in the pan bottom with the opening and the open top side sealed liquid-tight by means of a foil and the ink storage body and ink contained in the support element. The advantageous aspect of this lies in the achievement of an extremely high degree of prefabrication. Liquid-tight sealing also ensures that the unit can be stored for a very long time. However, there is a significant advantage in the fact that with correct storage position, the saturation process for absorption of the ink by the ink storage body begins immediately following production of the stamp cartridge, thereby allowing the ink storage body to be saturated completely once the stamp cartridge is used. An additional significant advantage is that a certain volume of excess ink can be poured in so that there is still liquid ink in the interior of the support element once the ink storage body has been saturated completely with ink. This ink can be absorbed by the printing plate during assembly of a stamp.

There is an advantage to a formation where the foil is made of thermal coated aluminum foil, preferably featuring a thickness of 30-50 μm and a directly extruded polymer coating on foil (13*a*), preferably of 20-50 μm thickness because it will facilitate creation of a liquid-tight seal.

It is also advantageous, however, if the foil used to create a liquid-tight seal for the top side and/or the opening is applied or attached to the support element by way of the "glass lidding" method, because it allows for the use of a simple procedure known in the art in other specialist fields, thereby ensuring the option of long-term liquid-tight storage and simple production.

However, a formation where the foil can be pierced at the opening when inserted into a stamp or a printing unit is also advantageous, because this way the user no longer has to remove the foil for installation into a stamp or printing unit. It is possible, for instance, to form a thinner foil at the openings.

With a formation where the foil on the top side of the support element is arranged so that it can be peeled off or removed, the advantage is that it can be for easily removed, in particular peeled off. Preferably the foil is attached so that upon peeling off, the entire foil can be peeled off in one piece and there are no remaining pieces stuck to the edges of the support elements.

Another advantageous formation is one featuring two areas in the support element, wherein one area is developed to hold the ink and the second to hold the ink storage body, because it allows for filling the support element one immediately after the other, i.e. first a certain volume of ink is filled into the support element and then the ink storage body can be inserted immediately. Thus, it is no longer necessary to wait during a certain saturation period as the ink storage body is saturated with ink; instead, the process of filling can be carried out in consecutive steps without disruption. As a result, production is simplified, accelerated and its price reduced significantly.

It is also advantageous, however, when a large enough ink volume is filled into the support element to saturate the ink storage body completely and there is an additional volume sufficient to be absorbed by an insertable printing plate because it allows for the greatest number of stamps possible.

A formation where the support element, in particular the pan bottom and elements that can be arranged therein are formed in a circular shape, is advantageous in that it can be used for a corresponding stamp. At the same time it is possible that the support element for accepting the printing plate features additional parts and components, such as gearing, etc., so that they can be used for a wide variety of stamp types.

Beyond that, however, the object of the innovation is also solved in that the pan bottom features at least one opening that is sealed liquid-tight by means of a sealing element. The advantage here is that it facilitates supplying stamp manufacturers with the support element and at the same time it is available as a replacement part. It is therefore possible for a seller to fit the stamp individually, i.e. he is able to add a special ink storage body for this stamp and fill it with special ink, for example, or equip this stamp with said accessories.

Finally, however, a formation where the support element features two areas with one formed for accepting ink and the other for accommodating the ink storage body is also advantageous because it permits clean and discrete assembly of the support element with ink and ink storage body. As a result it is not necessary to consider certain saturation times; instead, the stamp can be assembled without waiting periods.

For a better understanding of the innovation, it is explained in more detail by means of the following figures.

BRIEF DESCRIPTION OF THE DRAWINGS

The following simplified schematic illustrations show:

FIG. 11 Perspective view of a stamp cartridge in filling position;

FIG. 12 Plan view of stamp cartridge in storage position;

FIG. 13 Cross-sectional view through filled stamp cartridge with ink added;

FIG. 14 Example of the embodiment of a semi-finished product.

DETAILED DESCRIPTION

To begin with, it should be noted that the same parts are assigned the same reference signs or the same component designations in the differently described embodiments, with the ability to apply the disclosures included in the entire description analogously to the same parts with the same reference signs and/or component designations. The descriptions of the selected position specifications, such as above, below, lateral, etc., are also directly related to the figure described and illustrated and must be applied analogously to the new position. Furthermore, individual features or feature combinations from the different examples of the embodiment shown and described may also represent independent innovative solutions or solutions according to the innovation.

Figure 1:
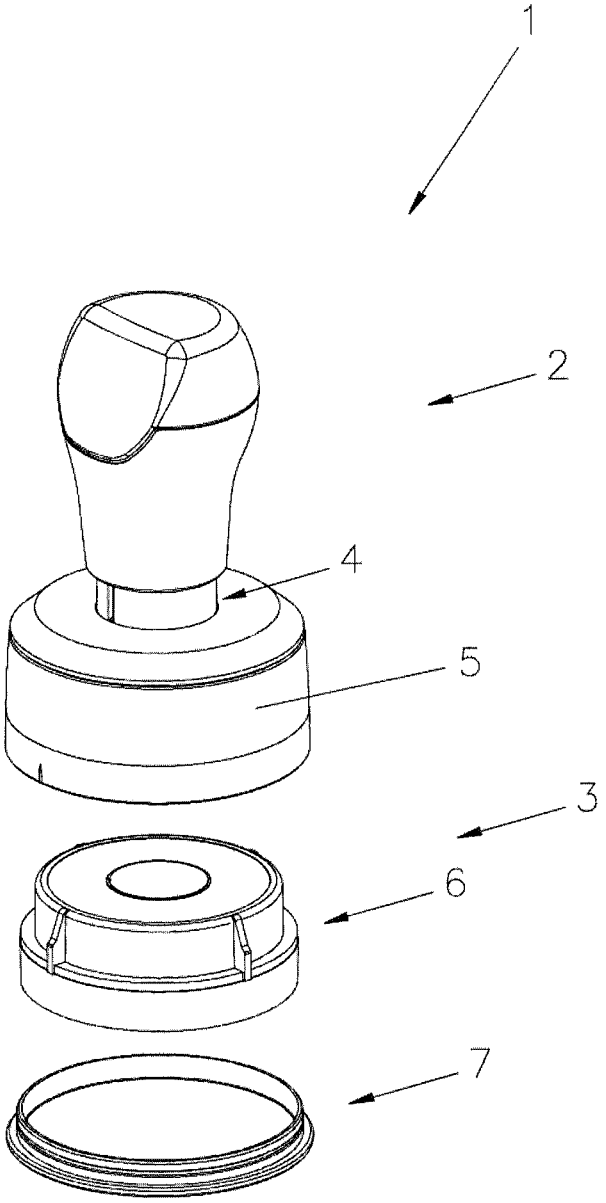
FIG. 1 Perspective view of a stamp according to the invention.

FIG. 1 depicts an exploded view of stamp 1. Roughly structured, this stamp 1 comprises an actuator unit 2 responsible for the stroking motion of stamp 1 and therefore triggering the imprint, and a printing unit 3 that is connected to the actuator unit 2 by means of a connecting element 4, and which features a housing 5, a support element 6 at least partially arranged inside housing 5 and a covering cap 7. For one, covering cap 7 is intended to prevent stamp 1 from drying out and for another to protect from unintended coloration when no imprint is made.

Figure 2:
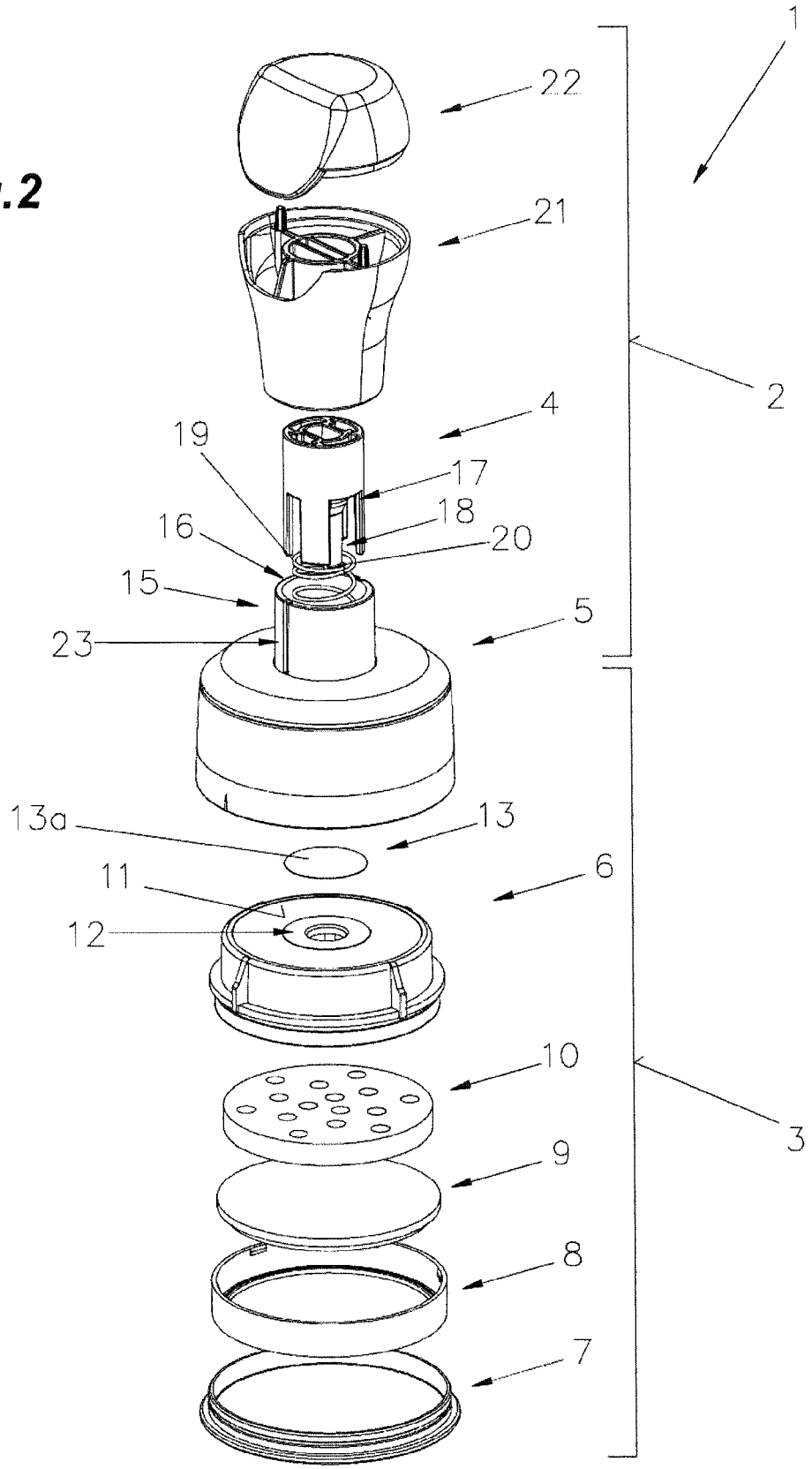
FIG. 2 Exploded view of the embodiment of the stamp.

As shown more clearly in FIG. 2, in addition to housing 5, support element 6 and covering cap 7, printing unit 3 features a retaining frame 8, a printing plate 9 and an ink storage body 10. In its assembled state, printing plate 9 is seated on the ink storage body 10. Ink storage body 10 is at least partially encased by support element 6; printing plate 9 and ink storage body 10 are stabilized by retaining frame 8 on or in support element 6.

Support element 6 arranged in housing 5 is formed in the shape of a pan, wherein a pan bottom 11 is facing the actuator unit 2 in the assembled state of stamp 1. This version of the embodiment provides for an opening 12 in pan bottom 11, with said opening serving to connect printing unit 3 with actuator unit 2 by means of connecting element 4.

Within the context of this invention, more than one opening 12 can be provided in pan bottom 11 or in support element 6, for example two, four, five, six, etc., openings 12, especially when at least some of the openings 12 are used as openings for refilling stamp color or ink or a coloring agent. However, even if there is only one opening 12, it can also be formed as an opening for refilling stamp ink.

At least during initial filling of stamp 1, opening 12 is sealed with a sealing element 13, wherein said sealing element 13 preferably formed of a foil 13*a*. Sealing element 13 produces a liquid-tight seal for opening 12 but is at least partially removable, as will be explained in more detail in the following. In the case of more than one opening 12, it is understood that several or all of these openings can be equipped with a sealing element 13.

In the most basic case, sealing element 13 is comprised of a foil 13*a*, which is either pierced upon assembly of stamp 1 or at least partially peeled off before assembly thereof. Foil 13*a* may be embodied as desired, as a single or multiple layer foil 13*a* formed of synthetic material and/or metal, e.g., aluminum, and may be affixed using prior art methods, such as the "glass lidding" method, for instance, by gluing or melting said foil to the support element. Within the context of this invention, it is also possible to use self-adhesive embodiments of the foil. The only essential element is that foil 13*a* be affixed to support element 6 in a liquid-tight manner by way of a method known in the art as "glass lidding" and therefore not addressed in detail here. "Glass lidding" is the preferred method used when maximum seal tightness is required, with preferential use of aluminum foils 13*a* that are glued or melted at high temperatures along the edge of the opening 12 to be sealed. Using foil 13*a* for sealing requires that foil 13*a*, in particular aluminum foil 13*a*, is coated with synthetic material heated above its melting point and then extruded directly onto foil 13*a*, in particular aluminum foil 13*a*, by means of extrusion dies. Thus, using the appropriate treatment, in particular heating of the elements, it is possible to affix foil 13*a* liquid-tight to the pan-shaped support element 6.

The preferred foil 13*a* for hot sealing is thermal coated aluminum foil 13*a*. For this purpose, foil 13*a*, in particular aluminum foil 13*a*, features a thickness of 30-50 μm and a directly extruded polymer coating on foil 13*a*, preferably of 20-50 μm thickness. Preferably, support element 6 is formed by means of a thermoplastic container or material so that optimal liquid-tight sealing can be achieved. Support element 6 is preferably formed so that support element 6, in particular the interior space or prechamber 24, is divided into two areas, with the first area formed to hold ink 46 and the second area to hold ink storage body 10, thereby facilitating or effecting separate filling of support element 6 and ink storage body 10 with ink 46.

Figure 4:
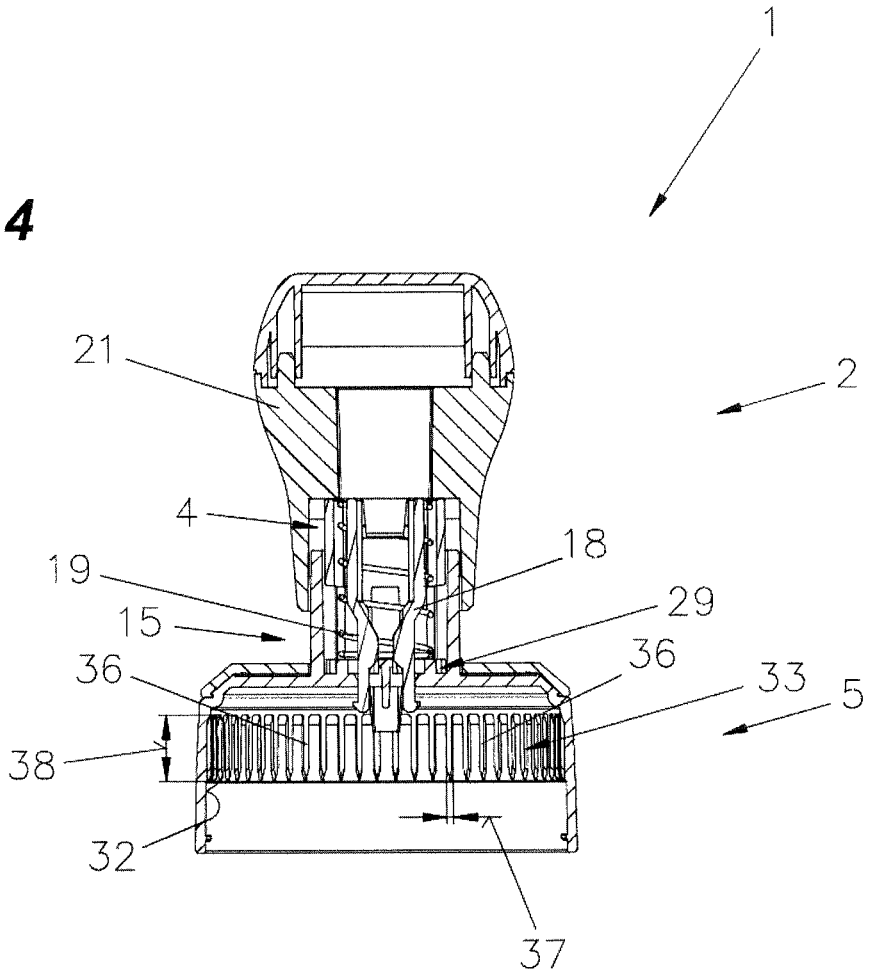
FIG. 4 Cross section of stamp before joining together printing unit and actuator unit.
Figure 4:
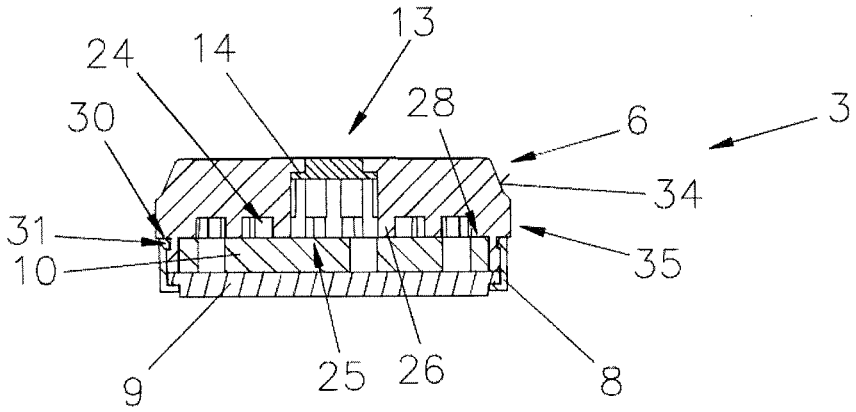

However, it is also possible that sealing element 13 is formed in the shape of a stopper as illustrated in FIG. 4 and inserted into opening 12 from below, i.e. from the inside out relative to the pan-shaped support element 6 and connected to support element 6. For this purpose, stopper-shaped sealing element 13 may feature a circumferential edge 14 attached to pan bottom 11 on the inside of support element 6, for instance, by being glued to support element 6. Sealing element 13 can also be pressed into opening 12. Since this type of stamp 1 is made largely of synthetic materials and support element 6 in particular is made of synthetic material, there is also the option that sealing element 13 is already intended in opening 12 of support element 6 and is extruded during production by means of what is known as the 2-K injection molding process. It is also possible that sealing element 13 is developed in form of a spherical seal similar to the spherical seal of a fountain pen cartridge. If support element 6 is positioned on a level (filling position) during filling, the sphere closes opening 12; upon rotating support element 6 for assembly of stamp 1, opening is unlocked because the sphere is lowered or ejected (assembly position or storage position).

Housing 5 features a dome-like attachment 15 facing in the direction of actuator unit 2. Connecting element 4 is formed to at least approximate the shape of a cylinder, wherein recesses 17 are formed in a lower area of the cylinder jacket in this version of the embodiment. It is not mandatory that these recesses 17 be provided; as a result, the cylinder jacket of connecting element 4 can also be formed to be solid.

The outer diameter of connecting element 4 is adapted to the inner diameter of dome-like attachment 15, thus serving as an axial guide for connecting element 4. Furthermore, connecting element 4 features at least one catch post 18, preferably two, for establishing the connection with printing unit 3, as will be explained in detail in the following. In the process, this catch post 18 or these catch posts 18 engage with and catch in opening 12 of support element 6.

Spring 19 is arranged in stamp 1 between the cylinder jacket on the one hand and catch posts 18 on the other, with said spring further supported in dome-like attachment 15, such as by means of a corresponding rib, as shown more clearly in FIG. 4. This spring 19 allows for printing plate 9 arranged in printing unit 3 to be displaced from neutral setting into print setting against a resetting force so that an imprint can be generated and after completion thereof, for actuator unit 2 and thus printing plate 9 as well to return automatically into neutral setting once there is no longer any force exerted on stamp 1. Catch posts 18 feature snap-in noses 20 in the lower end region that engage below the edge of opening 12 of support element 6.

In addition to connecting element 4, actuator unit 2 also features a handle piece 21 that may feature a transparent cover 22 in a corresponding recess in handle piece 21. It is a known fact that the purpose of these types of covers 22 is to store a sample of the imprint generated by stamp 1.

Handle piece 21 is pushed onto connecting element 4. For this purpose handle piece 21 features the appropriate ribs or supports on the inside, serving to establish the connection with connecting element 4. In addition or in the alternative, diameters can be dimensioned so as to produce a friction lock between handle piece 21 and connecting element 4.

In the alternative or in addition thereto, dome-like attachment 15 may feature at least one guide slot 23 and handle piece 21 may be equipped with a rib at an interior surface facing attachment 15, with said rib engaging in guide slot 23 in order to guide actuator unit 2 during the axial movement. For this purpose, this guide slot 23 may also feature a dovetailed cross-section.

Figure 3:
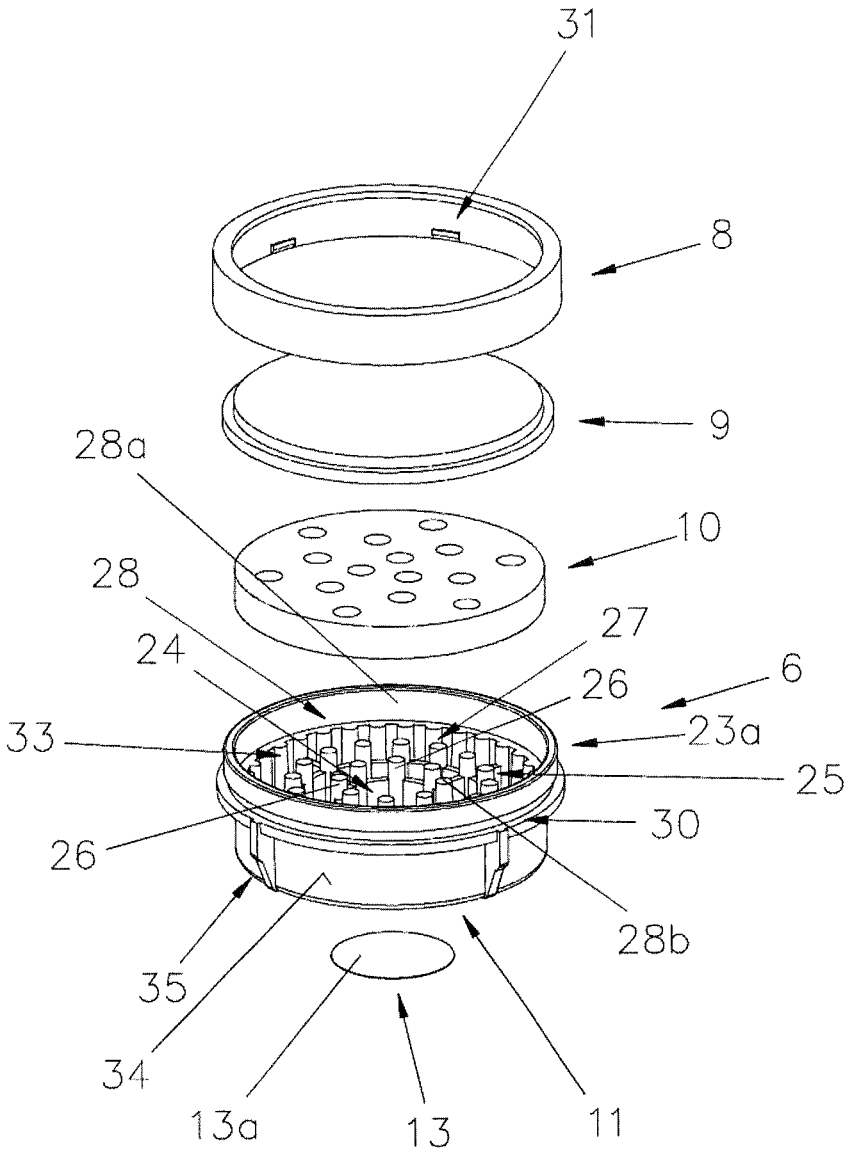
FIG. 3 Exploded view of the printing unit.

FIG. 3 shows the perspective view of the pan-shaped support element 6 in the inverted position, ink storage body 10, printing plate 9, sealing element 13 and retaining frame 8 once more in an exploded view. This inverted position of support element 6 is the (initial) filling position with the open top side 23*a* facing upward and support element 6 resting on pan bottom 11. In order to fill stamp 1, the pan-shaped support element 6 with inserted or pressed-in sealing element 13 placed upside down onto a level area to facilitate filling a prechamber 24 of support element 6 with stamp ink to the desired level or with the desired volume.

To improve detection of this desired level, in particular while adding black stamp ink, for example, this prechamber 24 of support element 6 may feature indicator elements 25, preferably in the form of pins 26 arranged or formed on interior surface 27 of support element 6 and said pins indicating at least the maximum fill height of stamp ink. Here, indicator elements 25 can be formed in the shape of pins protruding from interior surface 27 of pan bottom 11; likewise, a circumferential rib 28 may be arranged in the lateral wall area 28*a* of support element 6. Where applicable, only one of these indicator elements 25, in particular pin 26, may be intended or the number of pins represented in FIG. 3 is not to be seen as limiting, respectively. Ink is filled to pin height or up to the elevation of rib 28, with the fill volume adjusted to the stamp ink capacity of ink storage body 10. The preferred fill level lies just below pin surface 28*b*. Thereby always filling an exact, predefinable ink volume into the stamp is made easy. At the same time it is possible that indicator elements 25 and rib 28 are formed to serve as a supporting surface for ink storage body 10 so that upon being inserted, ink storage body 10 is positioned above the ink added to prechamber 24 (not depicted). Therefore, if stamp ink is added to a level just below the support area, in particular pin surface 28*b*, ink storage body 10 can be inserted without obstruction, thereby preventing soiling as a result of displacement.

Here it should be noted that, as is known in the art, ink storage body 10 may consist of foam plastic of at least partially porous structure for accepting the stamp ink.

The next step is to insert ink storage body 10 into support element 6 and to place printing plate 9 on top thereof and finally to connect these components by means of retaining frame 8. In this state, the system still is "inactive", i.e. the stamp ink still is not absorbed by ink storage body 10, thereby facilitating clean assembly of the parts. In this regard it must be noted that printing plate 9 is placed on the surface of lateral walls 28*a* and connected to support element 6 by means of retaining frame 8. Here, retaining frame 8 pushes printing plate 9 against lateral wall 28*a*, thereby creating an excellent seal by means of printing plate 9 and enabling the stamp ink to escape only by way of the intended imprint. It is possible, of course, to form lateral walls 28*a* in a larger size so that printing plate 9 is inserted into support element 6 like ink storage body 10.

Activation is accomplished by rotating the filled support element 6 holding ink storage body 10 and printing plate 9 180°, as shown in FIG. 4, thereby causing stamp ink to flow from prechamber 24 onto ink storage body 10 and to be absorbed by the latter and subsequently to be transferred to printing plate 9 for generating the imprint. Said printing plate may be developed according to prior art.

Figure 5:
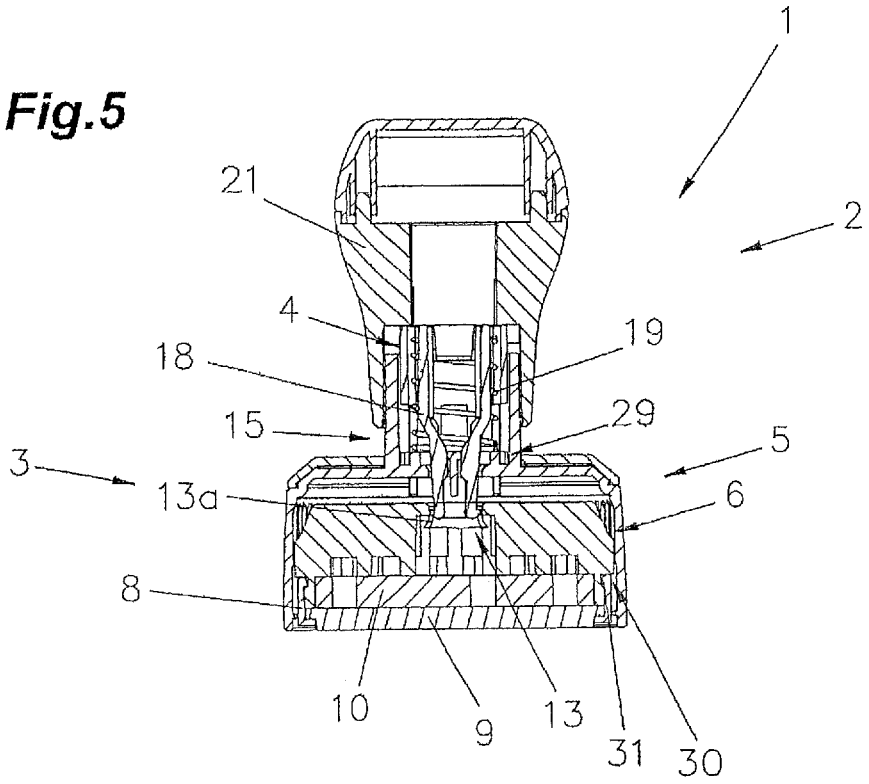
FIG. 5 Cross section of stamp after joining together printing unit and actuator unit.

The connection with actuator unit 2 by means of connecting element 4 is established by pushing actuator unit 2 over dome-like attachment 15 of housing 5 of printing unit 3 and executing an initial actuation stroke of actuator unit 2 in the direction of printing unit 3. In the course of this actuation stroke, catch posts 18 push sealing element 13 at least partially out of opening 12 of support element 6, causing the former to open and enabling both catch posts 18 of connection element 4 to engage with or snap into support element 6 by way of opening 12, thereby establishing the connection as is shown in FIG. 5. In the case of foils 13*a*, a remnant of foil 13*a* may remain stuck on support element 6 (as shown in FIG. 5), unless these foils 13*a* are attached to the outside of support element 6 already and must be removed manually or, precisely, do not have to be removed prior to assembling stamp 1 because foil 13*a* can simply be pierced by catch posts 18. This also means that according to a version of the embodiment, sealing element 13 may feature a predetermined breaking point, i.e. at least a partial narrowing of the material, causing sealing element 13 to break at this predetermined breaking point during assembly and only a portion of sealing element 13 to be pushed out and into prechamber 24 of support element 6.

As shown in FIG. 4, spring 19 is supported by supporting element 29 arranged between catch posts 18, thereby causing said spring to be compressed during the actuation stroke and to return to neutral setting as a result of relaxation of the system, i.e. actuator unit 2 of stamp 1.

Here it should be noted that the number of two catch posts 18 according to this version of the embodiment is not to be seen as limiting for the invention, but more than two such catch posts 18 may be provided, such as four. It is also possible to allow for only one catch post 18, with the option of providing an appropriate counter bearing at support element 6 or housing 5 in place of a second catch post 18.

It should be noted that in this version of the embodiment indicator element 26 in the form of the circumferential rib 28 forms a contact surface for ink storage body 10 at the same time. The pin-type indicator elements 25 may also come in contact with ink storage body 10.

Opening 12 may be exposed simply by pulling handle piece 21 off connecting element 4, thereby allowing for easy filling, i.e. refilling of stamp 1. In the alternative, refilling can be achieved by removing printing unit 3 and either resaturating ink storage body 10, in particular with support element 6 rotated 180°, or replacing it with a new, already saturated ink storage body 10 or by inserting a stamp cartridge 45 as described in the following.

In this version of the embodiment of stamp 1, support element 6 features a circumferential groove 30 along its outer surface as shown in FIG. 3. For this purpose, retaining frame 8 or the holding ring features snap-on catches 31 in an end region, forming a "tongue and groove connection". Due to the circumferential groove 30 it is possible to connect retaining frame 8 with support element 6 in any position, i.e. the radial positioning of the parts to each other is immaterial. It is possible to arrange more than two snap-on catches 31 spread around the inner circumference of retaining frame 8. If appropriate, a circumferential rib can be formed as a snap-on catch 31. Snap-on catch(es) 31 may feature a slanted area, as illustrated in FIG. 4, in order to facilitate snapping into groove 30 because this facilitates pressing snap-on catches 31 to the outside while pushing them up over the slanted area.

FIGS. 4 and 5 also show the dome-like attachment 15 of housing 5 arranged between handle piece 21 and cladding of connecting element 4 in the assembled state of stamp 1, thereby creating a guide for actuator unit 2 during the axial stroke.

As shown more clearly in FIG. 4 and partially in FIG. 3, in this embodiment of stamp 1, gearing 33 is arranged on the interior surface 32 of housing 5 on the one hand, and protruding ribs 35 are arranged on an exterior surface 34 of support element 6 on the other. Here, gearing 33 is formed along the interior circumference of housing 5 and in the form of interlocking grooves 36 in the jacket area of housing 5. For this purpose, it is possible to form a thicker wall at least in this region of housing 5 than in the lower region, as shown in FIG. 4. The interlocking grooves 36 feature a groove width 37 dimensioned so that they can accept ribs 35 of support element 6. In addition, groove length 38 in axial direction is selected so that in print setting (FIG. 7) and neutral setting of printing unit 3 ribs 35 engage with gearing grooves 33. However, ribs 35 are released in the positioning setting (FIG. 8) of printing unit 3, which is reached when printing unit 3 is pushed beyond the print setting by means of axial displacement, therefore facilitating the radial rotation of printing unit 3, i.e. pushing support element 6 out of gearing 33 or rendering said support element movable.

One option is to taper the upper end of gearing grooves 36, i.e. the end facing the dome-like attachment 15. As shown in FIG. 4, it is further possible that the lateral walls of two gearing grooves 36 arranged next to each other may be formed to slant outward and together form an acute angle. Thus, insertion of ribs 35 into gearing grooves 36 is facilitated. It is therefore possible to accomplish the alignment of support element 6 with gearing 33 by inserting ribs 35 on support element 6 which are completely or partially arranged around support element 6 into gearing grooves 36, although a version of the embodiment without acute angles is also an option. Basically, the gap between gearing grooves 36, i.e. the gap between two gearing grooves 36 arranged side by side can be chosen arbitrarily, although with the gap decreasing between grooves the accuracy of printing plate 9 positioning can be increased as a result of a greater number of different positions compared to gearing grooves 36, where the gap between the grooves is larger.

A version of the embodiment thereto may provide a greater groove length 38 of gearing grooves 36 so that support element 6 by means of ribs 35 engages partially with these gearing grooves 36 in the positioning setting as well, with rotation of printing plate 9 facilitated in the positioning setting of printing unit 3 in this case as a result of the ability to rotate the retaining frame 8.

Within the context of this invention there is also the option to form gearing grooves 36 on the exterior surface 32 of support element 6 and ribs 35 on the interior surface 32 of housing 5. The effect of doing so is the same.

Furthermore, the number of ribs 35 (four) depicted in FIG. 3 on the one hand, and the number of gearing grooves 36 depicted in FIG. 4 on the other (here, a longitudinal section of one half of stamp 1 is depicted so that the number of gearing grooves 36 has to be roughly doubled) is not to be seen as limiting for the invention. Thus, there is the option to provide a number of ribs 35 deviating from four, such as only one or two, three, five, six, eight, etc., or the number can be increased to an amount where ribs 35 form their own gearing, working together with gearing 33 of the corresponding counter element, depending on where gearing 33 or ribs 35 are arranged. In particular, the number of ribs 35 of the additional gearing may correspond to the number of gearing grooves 36 of gearing 33.

On the other hand, the number of gearing grooves 36 can also be matched to the number of ribs 35 with the result that no gearing is formed. Doing so will limit the relative adjustability of support element 6 in radial direction, but it is possible to achieve a rough setting, with fine-tuning realized by the ability to rotate retaining frame 8.

An additional option exists according to another version of the embodiment, with formation of ribs 35 protruding from the interior surface 32 of housing 5 as well as ribs 35 protruding from the exterior surface 34 of support element 6, resulting in a type of gearing with two gear wheels interlocking, i.e. ribs 35 of support element 6 engage with ribs 35 of housing 5, which requires that the appropriate gap between ribs 35 is selected.

According to another version of the invention's embodiment, retaining frame 8 may also feature at least one such rib 35 that engages with gearing groove 36 in the print or neutral setting and is released in the positioning setting, thereby facilitating the ability to rotate printing plate 9 with the option that in the positioning setting support element 6, i.e. ribs 35 arranged thereon, are released from gearing grooves 36. Here, another option is for rib(s) 35 to be arranged exclusively on the exterior surface of retaining frame 8.

With the most basic version of the embodiment it is possible to provide several ribs 35 only on the interior surface 32 of housing 5 or the exterior surface 34 of support element 6 and/or retaining frame 8, with said ribs in the print setting or neutral setting of stamp 1 forming a friction lock with the surface of the respective opposite component and therefore creating anti-rotation safety, although a counter element on the respective component working together with the component is advantageous because of increased anti-rotation safety.

Therefore, each version of the embodiment features an anti-rotation safety element preventing at least unintentional rotation of printing plate 9 in the print setting.

In general, ribs 35 can feature a length approximately corresponding to groove length 38 or ribs 35 may cover only a portion of groove length 38, as shown in FIG. 5. Preferably, ribs 35 are integrally connected or formed with the respective component.

In addition to the at least approximately rectangular front area of ribs 35, as shown in FIG. 3, these ribs 35 may also feature a cross section tapering from surface 34 or 32 of support element 6 or housing 5 forward in order to facilitate insertion into gearing grooves 36 or grooves, if no gearing is formed along the circumference of the respective component. Conversely, there is also the option that ribs 35 feature an increasing cross section, with gearing grooves 36 or grooves featuring a cross section form complementary thereto in this case, i.e. they are provided with an undercut.

Figure 6:
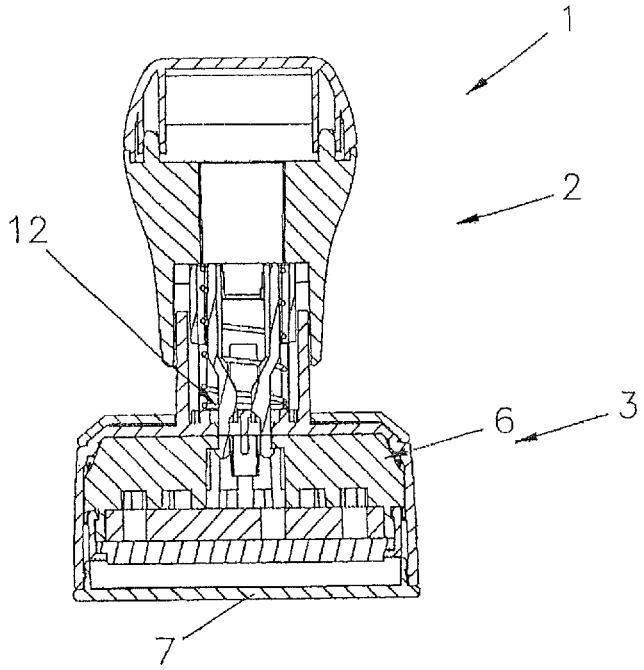
FIG. 6 Stamp according to FIGS. 4 and 5 after first actuation stroke of the actuator unit.
Figure 7:
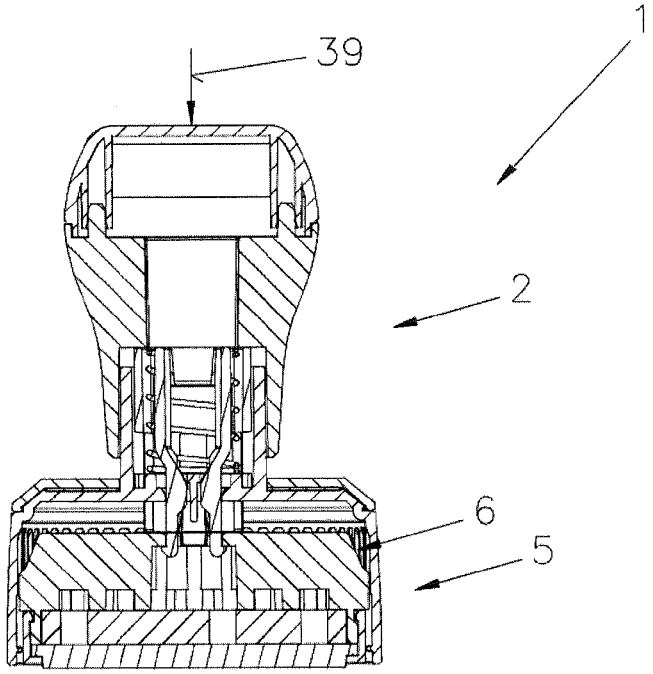
FIG. 7 Imprint setting of stamp according to FIGS. 4 to 6.

FIG. 6 shows stamp 1 completely assembled in neutral setting wherein actuator unit 2 is interlocked with printing unit 3 and opening 12 exposed at the top side of support element 6 to enable resaturation of the system at a later time. Covering cap 7 is attached to printing unit 3, in particular connected to the printing unit by means of a snap-on lid or a screw closure, with the option of creating a friction lock by appropriate adjustment of the diameter. FIG. 7 depicts how stamp 1 is used to create an imprint by removing covering cap 7 (FIG. 6) and moving handle piece 21 towards the imprint area (arrow 39), thereby causing support element 6 to be moved toward the imprint area as well. In the process, printing plate 9 protrudes above housing 5.

Figure 8:
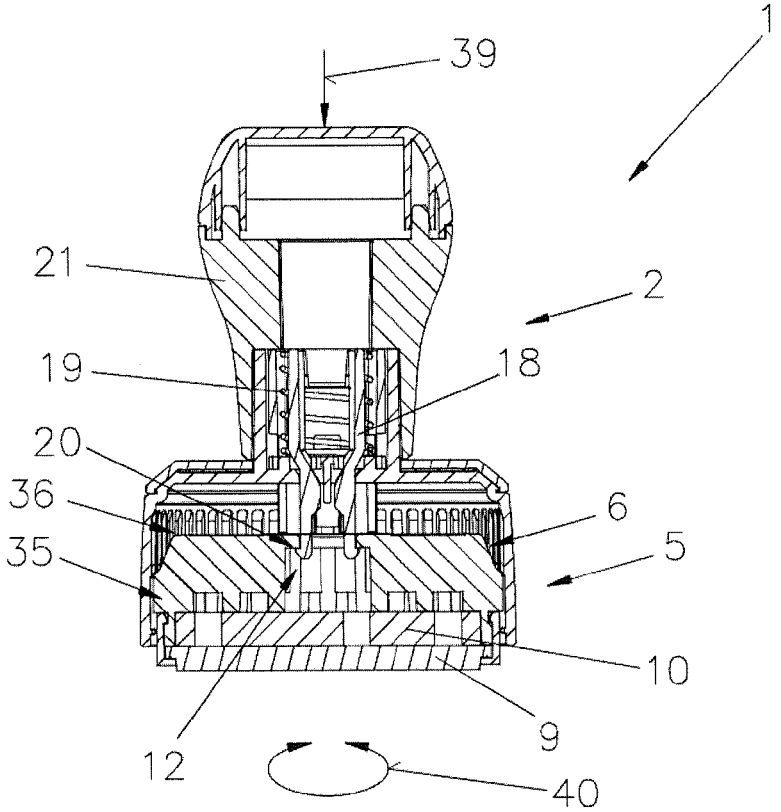
FIG. 8 Cross section of stamp according to FIGS. 4 to 7 in positioning setting.

FIG. 8 shows a cross section of stamp 1 in positioning setting in order to achieve radial alignment of printing plate 9. Handle piece 21 is used to push support element 6 out of housing 5 in the axial direction until ribs 35 no longer engage with gearing grooves 36. As a result it is possible to rotate support element 6 together with printing plate 9 in the radial direction, according to double arrow 40, and therefore correctly align the print image without having to disassemble stamp 1. In this position, catch posts 18 are still engaged in opening 12 by means of snap-in noses 20 so that support element 6 is still connected with stamp 1. Since in this position support element 6 protrudes below housing 5 of stamp 1, it can be gripped easily without having to touch printing plate 9. After completion of the setting, handle piece 21 is released again so that stamp 1 returns to neutral setting by means of the preload of spring 19. At the same time ribs 35 are once again brought to engage with gearing grooves 36, however not with the same gearing grooves 36 used before the alignment of printing plate 9.

This mechanism of adjustability is applicable to the other versions of the embodiment described above.

Figure 9:
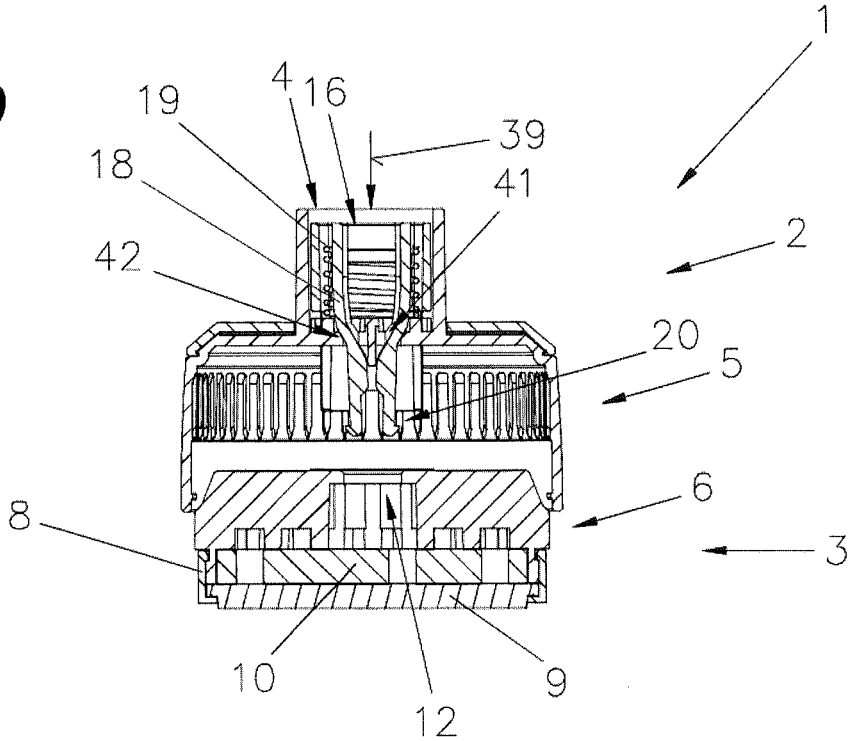
FIG. 9 Cross section of stamp according to FIGS. 4 to 8 in unlocking position.

FIG. 9 shows stamp 1 in the unlocking position. By pulling off handle piece 21 (e.g., FIG. 8), the entire printing unit 3 can be detached from actuator unit 2. To accomplish this, connecting element 4 is pushed all the way until stopped by housing 5 (arrow 39), with catch posts 18 of connecting element 4 compressed and snap-in noses 20 slipping out of opening 12 of support element 6. Thus, the locking mechanism is released automatically as a result of axial displacement of connecting element 4. This allows for rough prepositioning of printing unit on the one hand and for simple replacement of the entire printing unit 3, if needed, or for insertion of a new, in particular a presaturated ink storage body 10 or a new stamp cartridge 45, unless stamp 1 is intended for resaturation, and/or for insertion of a new printing plate 9 on the other. For this purpose, only retaining frame 8 is to be removed from support element 6.

Catch posts 18 are offset or stepped along their vertical course, including a slanted transitional area, wherein the gap between the two catch posts 18 in the interlocking area with support element 6 is narrower than in the area of spring 19. In addition, housing 5 features an opening 41 in the area of opening 12 of support element 6 for partial feed-through of catch posts 18. During the axial displacement, in their upper region facing connecting element 4 catch posts 18 abut against a boundary surface 42 of this opening 41 facing catch posts 18, causing them to be compressed as a result of the axial movement. As a result, the lower regions of catch posts 18 generating the catch mechanism with support element 6 are further compressed and thus release the catch mechanism. The return of stamp 1 into neutral setting automatically causes catch posts 18 to return to their starting position as well.

As shown in FIG. 9, boundary surface 42 of opening 41 may be slanted towards the inside in the area facing handle piece 21 so as to facilitate catch posts 18 sliding off said boundary surface.

It is not mandatory to form catch post(s) 18 in three sections, as shown in FIG. 9; instead, catch posts 18 may also feature a nearly straight-line progression, in this case arranged to traverse inward at an angle to facilitate snapping out of opening 12 as a result of axial displacement. In general, catch posts 18 may also be formed differently, preferably retaining the function of the automatic release described.

As shown in FIG. 9, handle piece 21 is also removed for resaturating stamp 1 with stamp ink, although here stamp 1 is resaturated in neutral setting (FIG. 6). For this purpose, covering cap 7 is once again arranged on housing 5, printing plate 9 is in neutral setting, i.e. there is a gap between printing plate and covering cap 7. Removal of handle piece 21 exposes recesses 16 and after sealing element 13 has been pushed out or at least partially removed, prechamber 24 of support element 6 (FIG. 3) is exposed for refilling.

As explained above, ink storage body 10 can also be refilled or resaturated outside of stamp 1 by removing or snapping out the entire printing unit once handle piece 21 has been pulled off.

Figure 10:
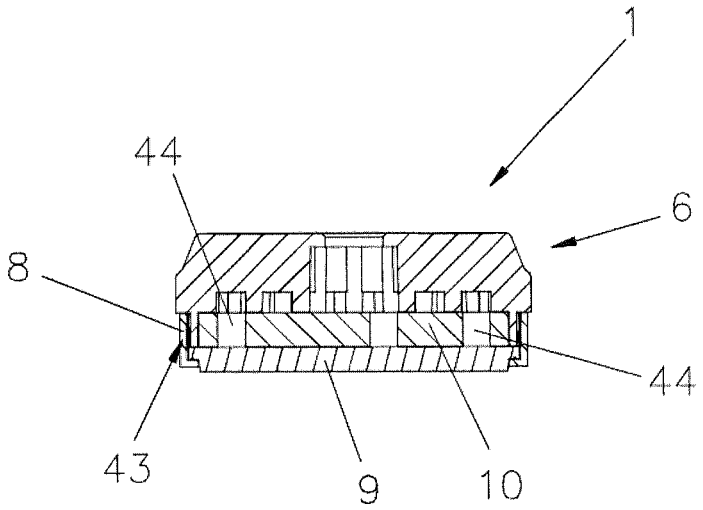
FIG. 10 Cross section through part of a version of embodiment of the printing unit.

Finally, FIG. 10 shows a version of the embodiment of stamp 1, wherein only support element 6, including ink storage body 10, printing plate 9 and retaining frame 8 are depicted. Here, retaining frame 8 is connected to support element 6 by means of a threaded connection 43. The dimensions are set so that in the unscrewed state of retaining frame 8 printing plate 9 cannot be rotated against ink storage body 10 and the latter in turn cannot be pressed against support element 6. The ability to rotate printing plate 9 is achieved by slightly loosening retaining frame 8, such as by one quarter of a turn, thus releasing the compression and therefore stabilizing printing plate 9 more or less loosely. A bayonet catch can be intended as well in place of threaded connection 43.

It is possible to develop ink storage body 10 not only partially porous, but in addition it may feature continuous recesses 44, such as drilled holes, in order to accelerate saturation time of ink storage body 10 after support element 6 has been rotated. These recesses 44 can also be provided in the form of punch-outs in ink storage body 10. These recesses 44 can feature various diameters or shapes. It is further possible for these recesses 44 to feature a cross section deviating from a circular cross section, such as square, elliptical, rectangular, etc. It is also possible for recesses 44 not to extend all the way through the entire diameter of ink storage body 10 but formed only across a partial area of the diameter of ink storage body 10.

With respect to opening 12 in support element 6, it must also be noted here that its cross section may deviate from the one depicted, for example, it may be square, rectangular, etc. Support element 6 or housing 5 may also feature a cross section deviating from the one depicted, e.g. a square, oval or polygonal cross section.

In addition it should be noted that connecting element 4 may also be formed integrally with handle piece 21, thereby rendering the version of the embodiment according to FIG. 8 particularly advantageous for refilling stamp 1. Another option is for snap-on catches 31 (FIG. 3) not to be arranged on retaining frame 8 but on support element 6 and the corresponding, preferably circumferential groove 30 (FIG. 3) on the retaining frame. Although all of the above examples of the embodiment show pan bottom 11 of support element 6 with at least one opening 12, within the context of the invention there is the option of forming this pan bottom 11 or support element 6 without such openings 12. In other words, support element 6 is produced to be liquid-tight due to the material used in fabrication. In this case, the connection of support element 6 with actuator unit 2 can also be established using connecting element 4, for example, by forming an indentation in pan bottom featuring an undercut, where appropriate. In place of an indentation, it is also possible to provide an elevation working with actuator unit 2 or connecting element 4 to create a connection.

Another option is to offer support element 6 as a semi-finished product by providing this support element 6 filled with stamp ink and with ink storage body 10 already inserted. However, printing plate 9 is not yet installed. In this version of the embodiment, support element 6, i.e. the pan opening is sealed liquid-tight by means of a stopper in the form of a lid. This stopper is removed before printing plate 9 is installed into support element 6. This step simplifies handling stamp 1 for the engraver of printing plate 9.

Beyond that, as shown in FIGS. 11 to 13, it is also possible to use a stamp cartridge 45 for stamp 1 to be arranged in stamp 1 for initial filling or refilling with ink.

FIGS. 11 to 13 depict stamp cartridge 45 in the unassembled state, with stamp cartridge comprising the pan-shaped support element 6 with pan bottom 11 and at least lateral walls 28*a*, as well as an open top side 23*a* facing pan bottom 11 for insertion of ink storage body 10. Pan bottom 11 features at least one opening 12 for fixing the elements, especially catch posts 18 of stamp 1. At the same time, at least the one opening is sealed liquid-tight by means of foil 13*a*. Furthermore, support element 6 is filled with ink 46 and holds ink storage body 10, with open top side 23*a* once again sealed by means of foil 13*a*. It is therefore possible for ink storage body 10 to begin absorbing ink 46 after fabrication of stamp cartridge 45 if ink storage body is rotated into storage position. Since support element 6 is sealed liquid-tight by means of foils 13*a*, it is possible to store the former for a very long time because the seal prevents ink 46 from drying out. Stamp cartridge 45 is filled or fabricated by placing support element 6 with sealed opening 12 upside down with open top side 23*a* facing upward, i.e. stamp cartridge 45 is placed on topside 11 with lateral walls 28*a* protruding upward, thus forming open top side 23*a*. Then ink 46 is filled into interior space, in particular prechamber 24, whereupon ink storage body 10 is placed onto indicator elements 25, pins 26 in particular. Preferably, the volume of ink 46 to be added is tailored to the absorbency of ink storage body 10 and printing plate 9, with level of ink 46 preferably remaining below indicator element 25, i.e. after complete absorption of the ink by ink storage body 10, that is upon its saturation, there is still additional liquid ink 46 not yet absorbed, the volume of which serves to saturate printing plate 9, with support element 6, in particular prechamber 24, nevertheless dimensioned so that with ink 46 filled in it lines up with indicator element 25 or lies just below, allowing for insertion of ink storage body 10 without soiling. After all components, in particular ink 46 and ink storage body 10 are filled or inserted into support element 6, the latter is sealed, preferably by means of the aforementioned "glass lidding" method so that support element 6 can then be inverted, allowing ink storage body 10 to begin absorbing ink 46.

This allows for achievement of a high degree of prefabrication and at the same time it renders stamp cartridge 45 ready for use immediately without any waiting period before ink is absorbed by ink storage body 10. This means the wait time for the first impression is significantly shortened because the only waiting period is the time required for printing plate 9 to be saturated, thereby allowing for imprinting immediately thereafter.

Stamp cartridge 45 is inserted by removing foil 13*a* from the open top side 11*a*, for the purpose of which preferably a tab 47 is arranged or formed to allow for an improved grip on foil 13*a*. Then printing plate 9 is placed onto ink storage body 10 and fastened, whereupon support element 6 is simply installed with opening 12 still sealed, i.e. foil 13*a* is not removed from opening 12 but simply pierced upon installation or initial imprinting and therefore catch posts 18 engage with opening 12.

FIG. 14 shows a semi-finished product, in particular a round one, formed from the pan-shaped support element 6. In the example of the embodiment shown, support element 6 features an opening 12 in pan bottom 11. This opening 12 is sealed by means of sealing element 13, wherein sealing element 13 is formed from foil 13*a*.

The interior area of pan-shaped support element 6 is formed so that an ink storage body 10 as described before can be inserted. It is also possible to insert an unsaturated ink storage body or one saturated with ink 46. Preferably support element 6 is also intended to feature a prechamber 24 for absorbing ink 46, i.e. with inserted ink storage body 10 prechamber 24 is arranged between the former and opening 12, with said prechamber formed for absorbing ink 46. It is an option, of course, to omit this prechamber 24 and to saturate ink storage body 10 with ink 46 prior to insertion and to insert it already saturated or to add ink 46 directly onto the inserted ink storage body 10.

In accordance with further use, the semi-finished product can be installed into printing unit 3 or stamp 1 after being filled, or the top side 23*a* can be sealed for storage by means of a sealing element 13, in particular foil 13*a*. The essential aspect here is to produce a liquid-tight seal on top side 23*a* as well, in particular using the "glass lidding" method to attach the seal.

The example of the embodiment shown in FIG. 14 illustrates merely the body, in particular support element 6, including opening 12 sealed liquid-tight by means of sealing element 13, in particular foil 13*a*, wherein said body is then further processed or used according to the versions of the embodiment previously described. This spare part or replacement part allows the stamp seller to insert his own ink storage body and/or ink.

In conclusion, stamp 1 is formed to include an actuator unit 2 and a printing unit 3, wherein printing unit 3 can be rotated in relation to actuator unit 2 in the positioning setting. At the same time, support element 6 for printing unit 3 or stamp 1 is formed preferably so that support element 6 features two areas, with one area formed for accepting ink 46 and the second area for accepting ink storage body 10. Furthermore, before being installed into stamp 1 or printing unit 3, opening 12 in pan bottom 11 is sealed liquid-tight with foil 13*a*, making it possible to fill the interior space with ink 46. However, in order to provide as much storage time as possible, after the filling process, in particular after introduction of ink 46 and ink storage body 10, top side 23*a* is also sealed liquid-tight by means of foil 13*a*, with foil 13*a* being removed from top side 23*a* for the purpose of integration into stamp 1 or printing unit 3.

The examples of the embodiment show possible versions of the embodiment of stamp 1, although a note is made here that the invention is not limited to the versions of the embodiment thereof specifically depicted; instead various combinations of the individual versions of the embodiment and this option for variations resulting from the technical teaching based on the concrete invention lies with the skill of the expert working in this technical field.

Basically, the point is made that the inventive solution is used preferably with stamps fitted with round printing plates 9 because this is where a multitude of different positions are possible. However, it is understood that the solution can also be used for oval, rectangular, square, etc., printing plates 9 or stamps 1, with only limited adjustment options available in that case.

Finally, as a matter of form it should be noted that some of the representations of stamp 1 or its components are not to scale and/or are enlarged and/or reduced for the sake of improved understanding of their structure.

Moreover, individual features or feature combinations from the different examples of the embodiment may represent individual and inventive solutions or solutions according to the invention, in particular the formation of catch posts 18 and related removal of support elements 6 from housing 5, ink storage bodies 10 or support element 6 filled with stamp ink as a semi-finished product.

The invention claimed is:

1. A stamp comprising a printing unit, an actuator unit and a connecting element, wherein the printing unit is connected to the actuator unit by means of the connecting element, and wherein the printing unit includes a support element and a printing plate, the printing plate is stabilized by the support element, and wherein the printing unit being configured to move through axial displacement along a predetermined axis by means of the actuator unit from a neutral setting into a printing setting, the printing plate being configured to move into a positioning setting wherein the printing plate is adapted to be rotated in its angular position about the predetermined axis relative to the actuator unit.

2. The stamp according to claim 1, wherein the printing setting is formed between the neutral setting and positioning setting.

3. The stamp according to claim 1, further comprising a retaining frame arranged on the printing unit to stabilize the printing plate, wherein the retaining frame is adapted to be rotated in the positioning setting of the printing plate.

4. The stamp according to claim 3, wherein the support element is connected to the retaining frame by means of a clip-on or snap-in connection.

5. The stamp according to claim 4, wherein the clip-on or snap-in connection comprises a tongue and groove connection.

6. The stamp according to claim 3, wherein the actuator unit comprises a housing for at least partial accommodation of the printing unit, wherein at least one anti-rotation element for the printing unit is arranged on at least one of an interior surface of the housing facing the printing unit or an exterior surface of the support element or the retaining frame facing the interior surface of the housing.

7. The stamp according to claim 6, wherein the anti-rotation element comprises ribs protruding from the interior surface of the housing in the direction of the printing unit and/or from the exterior surface of the support element in the direction of the interior surface of the housing.

8. The stamp according to claim 7, further comprising at least one gearing groove arranged to work together with the ribs formed on the interior surface of the housing or on the exterior surface of the support element.

9. The stamp according to claim 6, wherein the anti-rotation element comprises gearing.

10. The stamp according to claim 3, wherein the retaining frame is connected to the support element by means of a threaded connection.

11. The stamp according to claim 3, wherein the support element comprises at least one opening in which the connecting element is arranged to connect the support element with the actuator unit, and serving as a refilling opening for stamp ink.

12. The stamp according to claim 11, wherein the opening of the support element is sealed with a foil to create a liquid-tight seal.

13. The stamp according to claim 12, wherein the foil comprises a thermal coated aluminum foil having a thickness of 30-50 μm and a polymer having a thickness of 20-50 μm arranged on the aluminum foil.

14. The stamp according to claim 1, wherein the printing unit has locked and unlocked positions, wherein the printing unit can be moved from the locked position to the unlocking position by way of axial displacement wherein the connecting element releases connection with the support element.

15. The stamp according to claim 1, wherein the connecting element includes at least one catch post serving to connect the actuator unit with the printing unit.

16. The stamp according to claim 15, comprising at least two catch posts positioned toward each other to form a gap between them narrowing towards the support element.

17. The stamp according to claim 16, wherein each catch post comprises at least three sections, two of which at least traverse approximately vertically and a section in between is formed to traverse at an angle towards the inside.

18. The stamp according to claim 1, further comprising a ink storage body, wherein the support element comprises an area for accepting ink and a second area for accepting the ink storage body.

19. The stamp according to claim 1, wherein the support element comprises at least one indicator element.

20. A stamp cartridge for a stamp comprising: a pan-shaped support element having a pan bottom and at least one lateral wall and an open top side formed on the opposite side of the pan bottom forming an interior area for insertion of an ink storage body therein, wherein at least one opening is arranged in the pan bottom, and wherein the opening and the open top side are each sealed liquid-tight by a foil with the ink storage body received within the interior area and ink being contained in the support element; wherein the foil which is sealed to the open top side of the support element is configured to be permanently removed when integrating the stamp cartridge into the stamp.

21. The stamp cartridge according to claim 20, wherein the foil comprises a thermal coated aluminum foil including a thickness of 30-50 μm and a polymer having a thickness of 20-50 μm arranged on the aluminum foil.

22. The stamp cartridge according to claim 20, wherein the foil is arranged to create a liquid-tight seal on the support element according to a glass-lidding method.

23. The stamp cartridge according to claim 20, wherein the foil which is sealed to the opening in the pan bottom is pierceable to form an opening.

24. The stamp cartridge according to claim 20, wherein the support element comprises an area for accepting ink and a second area for accepting the ink storage body.

25. The stamp cartridge according to claim 20, wherein a volume of ink arranged in the support element allows for complete saturation of the ink storage body and an additional volume required for absorption by an insertable printing plate.

26. The stamp cartridge according to claim 20, wherein the support element including the pan bottom and elements adapted to be arranged therein are formed in a circular shape.

27. A semi-finished product for a stamp comprising: a pan-shaped support element including a pan bottom and at least one lateral wall and an open top side facing the pan bottom forming an interior area for insertion of an ink storage body, said support element further including an ink pre-chamber in fluid communication with the interior area of the support element for storing ink for absorption by the ink storage body when inserted therein, the ink pre-chamber having an open end and a closed end within the pan-bottom of the support element, the open end in fluid communication with the interior area of the support element, wherein at least one opening is arranged in the pan bottom with said opening sealed liquid-tight by means of a sealing element.

28. The semi-finished product according to claim 27, wherein the support element comprises a first area for accepting ink in the ink prechamber, and a second area for accepting the ink storage body.

* * * * *